US009144128B2

(12) United States Patent
Shin et al.

(10) Patent No.: US 9,144,128 B2
(45) Date of Patent: Sep. 22, 2015

(54) DIMMING SYSTEM OF LAMP USING LIGHT-EMITTING DEVICE

(71) Applicant: Merlot Laboratories Inc., Seoul (KR)

(72) Inventors: So-Bong Shin, Seoul (KR); Ok Hwan Kwon, Seoul (KR)

(73) Assignee: MERLOT LABORATORIES, INC., Seoul (KR)

( * ) Notice: Subject to any disclaimer, the term of this patent is extended or adjusted under 35 U.S.C. 154(b) by 0 days.

(21) Appl. No.: 14/201,245

(22) Filed: Mar. 7, 2014

(65) Prior Publication Data

US 2014/0292217 A1 Oct. 2, 2014

Related U.S. Application Data

(63) Continuation-in-part of application No. PCT/KR2013/006901, filed on Jul. 31, 2013.

(30) Foreign Application Priority Data

Aug. 6, 2012 (KR) ..... 10-2012-0085651

(51) Int. Cl.
*H05B 37/02* (2006.01)
*H05B 33/08* (2006.01)

(52) U.S. Cl.
CPC ..... *H05B 33/083* (2013.01)

(58) Field of Classification Search
USPC ..... 315/185 R, 194, 195, 209 R, 210, 224, 315/291, 299, 300, 301, 308
See application file for complete search history.

(56) References Cited

U.S. PATENT DOCUMENTS

| | | | | |
|---|---|---|---|---|
| 7,439,944 | B2 * | 10/2008 | Huynh et al. | 345/82 |
| 7,605,550 | B2 | 10/2009 | Ferentz et al. | |
| 8,686,651 | B2 * | 4/2014 | Lynch et al. | 315/192 |
| 8,890,432 | B2 * | 11/2014 | Jeong | 315/291 |
| 8,901,849 | B2 * | 12/2014 | Jeong et al. | 315/294 |
| 8,928,251 | B2 * | 1/2015 | Jeong | 315/291 |
| 8,952,620 | B2 * | 2/2015 | Jeong et al. | 315/186 |

FOREIGN PATENT DOCUMENTS

| | | | |
|---|---|---|---|
| KR | 10-0942234 | B1 | 2/2010 |
| KR | 10-1064906 | B1 | 9/2011 |
| KR | 10-1083785 | B1 | 11/2011 |

OTHER PUBLICATIONS

PCT Written Opinion (ISA) dated Nov. 18, 2013.

* cited by examiner

*Primary Examiner* — Thuy Vinh Tran
(74) *Attorney, Agent, or Firm* — Lucas & Mercanti, LLP

(57) ABSTRACT

A dimming system of a lamp using a light-emitting device includes: a power source including a power input terminal, a dimmer connected to the power input terminal, and a rectifier circuit; a lighting unit including light-emitting devices from a first light-emitting device to an $n^{th}$ light-emitting device; a light-emitting drive unit including a plurality of switching circuits individually connected to an output terminal of each of the light-emitting devices, and dimmer control circuits connected to the switching circuits of the first light-emitting device and configured to sense whether or not a current supply channel for the first light-emitting device is normally operated, and to output a control signal; and a dimmer drive unit parallel-connected to a connection line between the power source and a power input terminal of the first light-emitting device to form a bleeding current supply channel, and having a switch.

17 Claims, 12 Drawing Sheets

DIMMING SYSTEM OF LAMP USING LIGHT-EMITTING DEVICE

CROSS-REFERENCE TO RELATED APPLICATION

This application is a Continuation-in-part of PCT/KR2013/006901, filed Jul. 31, 2013, which claims the benefit of Korean Patent Application KR 10-2012-0085651 filed Aug. 6, 2012, the contents of each of which are incorporated herein by reference.

FIELD OF INVENTION

The present invention relates to a dimming system of a lamp using a light-emitting device.

BACKGROUND OF THE INVENTION

In general, a dimmer is an apparatus designed to physically adjust brightness of an incandescent lamp and for a long time has served as a lighting device capable of controlling light due to its characteristics described below.

FIG. 1A and FIG. 1B show a basic operation of the dimmer, VAC refers to an alternating current (AC) power voltage, and VDIM refers to an output voltage of the dimmer. When the AC power voltage is phase-cut by the dimmer, the differential output voltage is divided into regions having the same value as that of a region having a positive or negative value as shown in FIG. 1A. At this time, in order for the dimmer to be turned on normally, a current over a specific value must flow in a region, a voltage value of both ends of which is a positive or negative value. When the voltage is a positive or negative value, and the current is zero or under the specific value, the dimmer is turned off in a corresponding cycle, the output voltage is discharged.

Furthermore, the incandescent lamp has an electrical resistance property because electric power consumed in a tungsten filament is converted into heat and light, and thus when a voltage is applied to both ends of the incandescent lamp, it enables current to flow.

Accordingly, the incandescent lamp very well satisfies a condition that "current should flow when a voltage value required to a dimmer operation is present at both ends."

However, the incandescent lamp has high energy consumption, and accordingly, lamp technologies adopting a light emitting diode (LED) as a power source for energy saving have been continuously developed.

The light-emitting diode (LED) is a current drive device, and may normally operate when a constant current is stably supplied. In particular, since a drive current of the LED, which needs high electric power, is large (normally, 350 mA or more), a lot of heat is generated from the LED itself, and accordingly, a deterioration rate of luminance is larger than that of the LED at low electric power. This is directly associated with the LED's life span and acts as a very important factor in the lighting market.

For such a reason, the LED at high electric power is generally driven by a constant current, and here, a pulse width modulation (PWM) method is used so that the voltage of a switched-mode power supply (SMPS) used as the power supply of a first constant current can be more efficiently used.

However, due to the LED's characteristic of being driven by a constant current, additional circuits and various electronic components constituting the corresponding circuits are required for this method, and this leads to an increase in manufacturing costs of the lamp.

For such a reason, a method of rectifying an alternating current power source and applying it to a parallel-connected LED module is used, and LED lighting in which this method is used refers to AC direct type LED lighting. Accordingly, hereinafter, in the description regarding such an LED lighting type, the term "AC direct type LED lighting" will be used.

FIG. 2 is a view showing one example of conventional alternating current (AC) direct type LED lighting, and as illustrated in the drawing, a VAC voltage is outputted as a voltage VDIM in a phase-cut form by passing through the dimmer. Furthermore, the voltage VDIM passes through a rectifier, and thus a differential voltage thereof is converted into a single ended VRECT.

Furthermore, according to a level of the AC voltage converted into a common ground voltage, the VAC voltage is operated in a state of being divided into the operation sections of LED1 and CH1, LED1+LED2 and CH2, LED1+LED2+LED3 and CH3. At this time, even in the case of drive circuits in a form in which a separate LED current control unit is not provided, the same principle that the number of LEDs and corresponding channel current sources are combined according to a level of the input AC voltage and are driven is applied.

FIG. 3 shows operational waveforms at the time of applying a leading edge type dimmer to the AC direct type LED lighting according to FIG. 2, shows a case in which steepness of the operational waveforms of the dimmer is relative high, and shows voltage waveforms and current waveforms by steps and a normal or abnormal status of operation by sections.

As illustrated in the drawing, when the value of I_LED is more than a specific value, VDIM and VRECT waveforms follow waveforms of the Ac power source, whereas when the waveforms of VDIM and VRECT enter the section in which the value of I_LED is low, the waveforms of VDIM and VRECT cause malfunction regardless of the waveform of the AC power source. Due to this, LED currents are not maintained until the value of an AC voltage is reduced to zero, and the dimmer is turned off in advance. This is shown as a phenomenon in which a charge of a parasitic capacitor component being present in a dimmer output is naturally discharged to a leakage current path as a discharge path of the charge disappears. Accordingly, the value of VRECT is maintained at a high level, and thus minute electric currents also flow in a direction of the LEDs.

At this time, since a slope value of the dimmer is sufficiently large, brightness of the LEDs in a normal operation section is very high compared to that of the LEDs in an abnormal section, and accordingly, a user can feel that an operational status of the LEDs is a normal status without a large problem.

However, as shown in FIG. 4, when the wave steepness of a dimmer operation is relative low, an abnormal operational status of the LEDs is clearly recognized by the user.

That is, unlike FIG. 3, FIG. 4 shows voltage waveforms and current waveforms by stages and existence or non-existence of normal operations by sections when the wave steepness of the dimmer operation is relative low.

As illustrated, when all channels of the LEDs should be turned off because a dimmer wave steepness is low, the dimmer and drive circuits are abnormally operated in the entire region, and at this time, LED leakage currents generated due to a residual voltage of a parasitic capacitor component being present in the dimmer output cause an incorrect operation in which LED lighting is maintained in a state of being not turned off while shining dimly even in a dimmer angle section in which the LED lighting should be turned off.

In other words, the conventional AC direct type LED lighting causes a phenomenon generally called a flicker phenomenon which is one of very unsuitable factors in using the lighting lamp.

SUMMARY OF INVENTION

Various aspects of the present invention are directed to providing a dimming system of a lamp using a light-emitting device, the dimming system has a dimmer drive unit which is parallel-connected to a connection line between a rectifier circuit of an external alternating current power source and a lighting unit of a series connection structure of light-emitting devices to form a bleeding current supply channel and to be operated by it as prime power, so that an output current of a dimmer can be maintained until the output voltage of the dimmer is reduced to a zero value through an I-bleeding current path having a relatively large value even in a case where an I LED value is zero.

In an aspect of the present invention, a dimming system may include a power source including a power input terminal to which an external alternating current power source is applied, a dimmer connected to the power input terminal to receive an alternating current voltage applied, and a rectifier circuit for the output voltage of the dimmer; a lighting unit including light-emitting devices from a first light-emitting device positioned at the shortest distance from a connection point with the power source to an $n^{th}$ light-emitting device positioned at the longest distance from the power source, wherein the first light-emitting device is electrically connected to the power source, and the light-emitting devices are connected in series; a light-emitting drive unit including a plurality of switching circuits individually connected to an output terminal of each of the light-emitting devices constituting the lighting unit to form a current supply channel for the corresponding LED, and dimmer control circuits connected to the switching circuits of the first light-emitting device and configured to sense whether or not a current supply channel for the first light-emitting device is normally operated, and thereafter, to output a control signal according to a result of the sensing; and a dimmer drive unit parallel-connected to a connection line between the power source and a power input terminal of the first light-emitting device to form a bleeding current supply channel, and having a switch configured to turn on/off the bleeding current supply channel depending on the a control signal of the dimmer control circuits.

The light-emitting device may be a lighting-emitting diode (LED).

The dimmer drive unit may be turned on/off according to whether or not an output voltage of the power source for the first light-emitting device has a voltage value in a range which enables a corresponding current supply channel of the first light-emitting device to be driven normally.

The dimming system may further include a common grounding resistance in which the plurality of switching circuits are grounded in common, wherein the switching circuits includes: a switching element connected to the common grounding resistance at the same time as being connected to the output terminal of the light-emitting device; and a first comparator configured to compare a reference voltage corresponding to the light emitting device with a common voltage of the common grounding resistance, wherein depending on output of the first comparator, the switching element is switched to any one path of a first current path connected to the light-emitting device and a second current path connected to the common grounding resistance, thereby varying the common voltage of the common grounding resistance.

The switching element may be a field-effect transistor (MOS FET) which is configured such that a drain is connected to the output terminal of the light-emitting device, a source is connected to the common grounding resistance, and a gate is connected to the first comparator.

The dimmer control circuits may sense a gate voltage of the field-effect transistor, and thereafter, may output a control signal for the dimmer drive unit according to a sensing result.

When a drain voltage value of the field-effect transistor is a voltage value which enables a corresponding current supply channel to be operated, but does not enable a current supply channel in next order to be operated, the corresponding voltage value of the operable current supply channel may be set as a common voltage value in a source of the field-effect transistor individually included in each of the switching circuits.

The dimmer control circuits may sense a drain voltage of the field-effect transistor, and thereafter, may output a control signal for the dimmer drive unit according to a sensing result.

The dimmer control circuits may include: a second comparator in which a higher voltage value than an output voltage of the first comparator included in the switching circuits is applied to (+) input voltage under the condition that the output voltage of the first comparator is applied to (−) input voltage and is a voltage value which enables the corresponding current supply channel to be operated normally; and an inverting buffer configured to output an on/off control signal for a bleeding current supplying channel of the dimmer drive unit according to an output signal of the second comparator included in the dimmer control circuits.

The dimmer control circuits may sense a source voltage of the field-effect transistor, and thereafter may output a control signal for the dimmer drive unit according to a sensing result.

The dimmer control circuits may include: a second comparator in which the source voltage of the field-effect transistor included in the switching circuit is applied to (+) input voltage, and at the same time, a lower voltage value than an input voltage of the first comparator included in the switching circuits is applied to (−) input voltage; and an inverting buffer configured to output an on/off control signal for a bleeding current supplying channel of the dimmer drive unit according to an output signal of the second comparator included in the dimmer control circuits.

The dimmer control circuits may include a bias element that changes an operation condition of the dimmer drive unit by receiving a source voltage value of the field-effect transistor as a signal inputted for control of the dimmer drive unit, and enables the signal to be transmitted between a source output terminal of the field-effect transistor and an input terminal of the dimmer drive unit only in a direction of the dimmer control circuits from the source output terminal of the field-effect transistor.

When a direction relatively close to a connection point between the power source and the first light-emitting device is fixed as the front, the dimmer control circuits may be connected to the switching circuits, respectively and may be formed in plural number, and the switching circuits may be formed in the same structure as that of circuits of the dimmer drive unit so that the driving of each of the switching circuits is controlled by the control signals of the dimmer control circuits positioned at the rear.

The respective switching circuits may be turned on/off according to whether or not an input voltage of the dimmer control circuits positioned at the rear is a voltage value in a range which enables the light-emitting device of the corresponding current supply channel to be driven normally According to the present invention, as a dimmer drive unit, which is parallel-connected to a connection line between a rectifier circuit of an external alternating current power source and a lighting unit of a series connection structure of light-emitting devices to form a bleeding current supply channel and to be operated by it as prime power, is installed, an output current of a dimmer can be maintained until an output voltage of the dimmer is reduced to a zero value through an I_bleeding current path having a relatively large value even in a case where an I_LED value is zero, and an on/off operation of the dimmer can be stably and normally performed, whereby the light unit including a plurality of light-emitting diodes can be always normally turned on/off without malfunction such as flicker. Furthermore, this leads to the improvement of illumination intensity and energy efficiency of the lighting unit.

BRIEF DESCRIPTION OF DRAWINGS

FIG. 1B for VAC, an alternating current (AC) power voltage.

DETAILED DESCRIPTION

Hereinbelow, a dimming system of a lamp using a light-emitting device according to one embodiment of the present invention will be described in detail with reference to the accompanying drawings.

Figure 5:
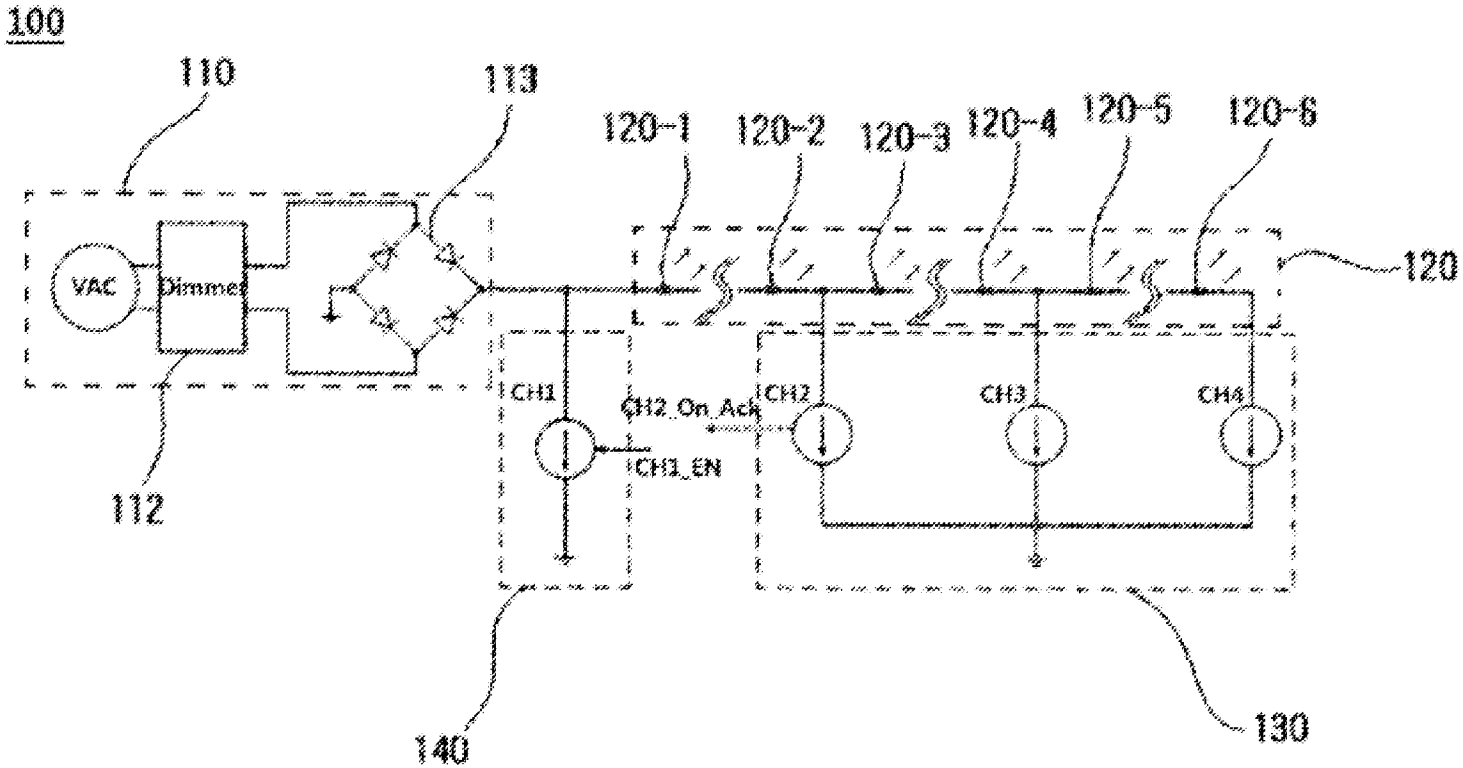
FIG. 5 is a view conceptually showing a dimming system of a lamp using a light-emitting device according to one embodiment of the present invention.

FIG. 5 is a view schematically showing a dimming system of a lamp using a light-emitting device according to one embodiment of the present invention.

As illustrated in the drawing, a dimming system of a lamp using a light-emitting device 100 according to one embodiment of the present invention (hereinafter referred to as "a lamp dimming system") includes: a power source 110; a lighting unit 120; a light-emitting device drive unit 130; and a dimmer drive unit 140. Furthermore, in the present embodiment, an example in which light-emitting devices of the lighting unit 120 are light-emitting diodes 120-1 to 120-6 (LED) is described, but the present invention is not limited thereto. Various light-emitting devices may be used within a scope which meets conditions capable of implementing an installation structure and operation of LEDs which will be described hereinafter in the same way.

The power source 110 includes a power input terminal (not shown as a reference numeral for the drawing) to which an external alternating current power source (AC power source, hereinafter referred to as 'alternating current power source') is applied; a dimmer 112 connected to the power input terminal to receive the alternating current power source; and a rectifier circuit 113 for rectifying an output voltage of the dimmer 112.

The lighting unit 120 includes the plurality of LEDs 120-1 to 120-6, namely, from a first LED 120-1 positioned at the shortest distance from a connection point with the power source 110, to an $n^{th}$ LED positioned at the longest distance from the power source 110. Furthermore, the first LED 120-1 is electrically connected to the power source 110, and all the LEDs included in the first LED 120-1 and the lighting unit 120 are connected to each other in series.

Figure 6:
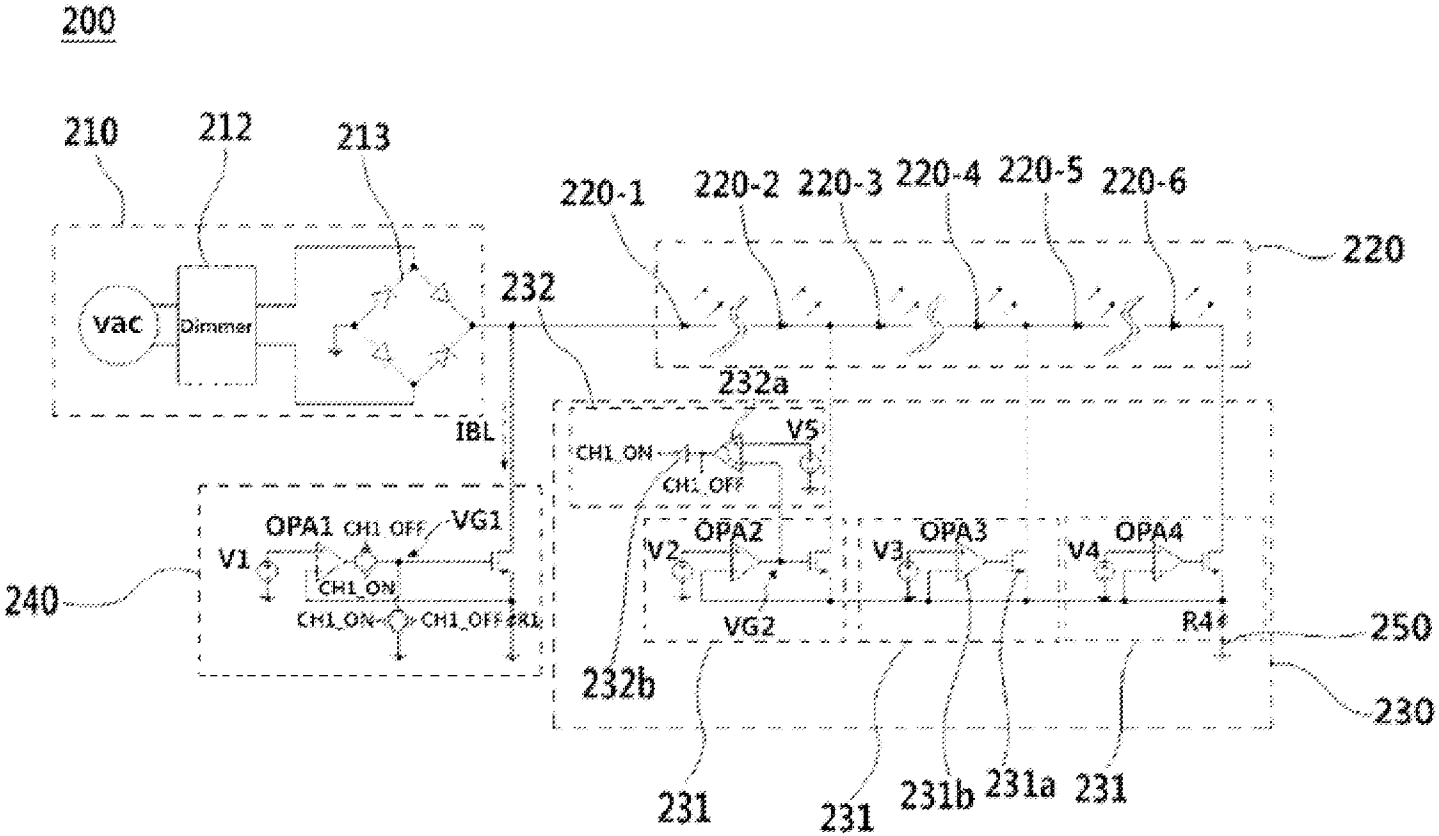
FIG. 6 is a view showing a first embodiment of a dimming system of a lamp using a light-emitting device according to one embodiment of the present invention.
Figure 7:
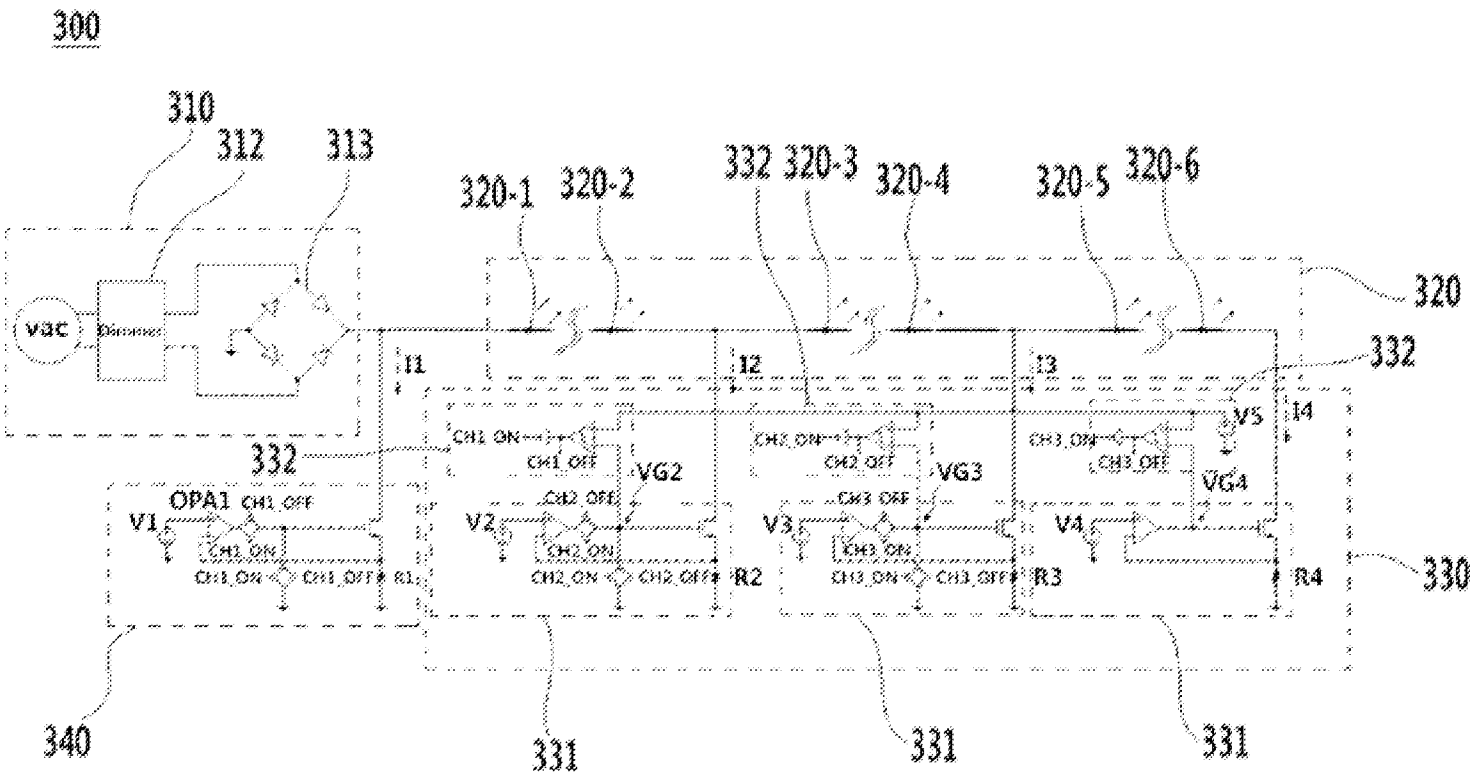
FIG. 7 is a view showing a second embodiment of a dimming system of a lamp using a light-emitting device according to one embodiment of the present invention.
Figure 8:
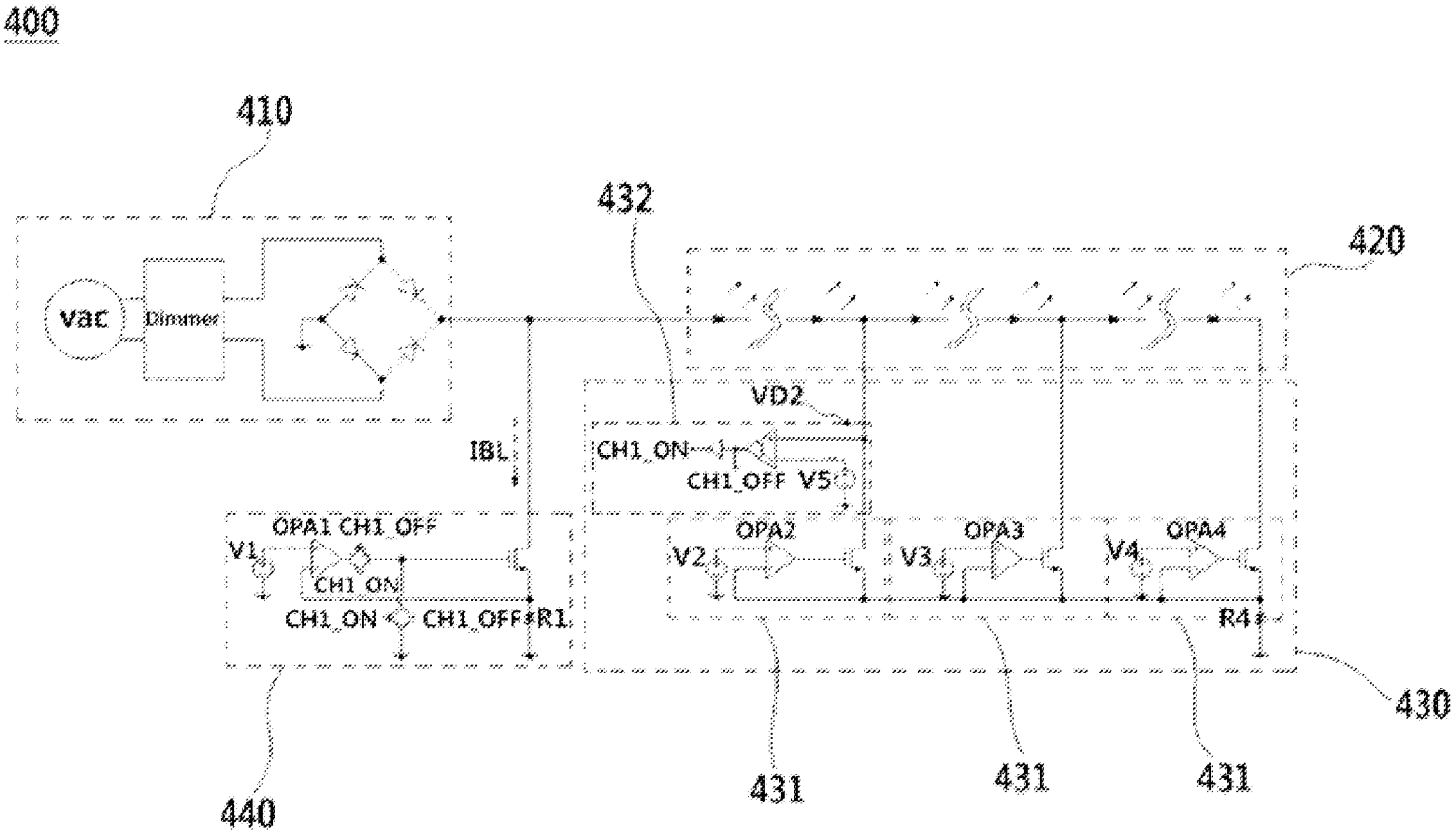
FIG. 8 is a view showing a third embodiment of a dimming system of a lamp using a light-emitting device according to one embodiment of the present invention.

The light-emitting drive unit 130 includes switching circuits (not drawn, see FIGS. 6 to 8) and dimmer control circuits (not drawn, see FIGS. 6 to 8).

The switching circuits are individually connected to an output terminal of each of the LEDs 120-1 to 120-6 constituting the lighting unit 120 to form a current supply channel for the corresponding LED. In other words, the number of the switching circuits is formed to be corresponding to that of the LEDs 120-1 to 120-6. Accordingly, the number of the current supply channels corresponds to that of each of the LEDs 120-1 to 120-6 and the switching circuits. Furthermore, the respective current supply channels will be abbreviated as a CH (channel). Accordingly, a first to $n^{th}$ CHs are formed to correspond to the first to $n^{th}$ LEDs. Hereinafter, the first CH, the second CH, and the $n^{th}$ CH will be referred to as CH1, CH2, and CHn, respectively.

The dimmer control circuit is connected to the switching circuit of the first LED 120-1, senses whether or not CH 1 to the first LED 120-1 is normally operated, and thereafter, outputs a control signal according to a result of the sensing to the dimmer drive unit 140.

The dimmer drive unit 140 is parallel-connected to a connection line between the power source 110 and the power input terminal of the first LED 120-1 to form the bleeding current supply channel, and also includes a switch to turn on/off the bleeding current supply channel depending on a control signal of the dimmer control circuits. Here, the dimmer drive unit 140 is turned on/off according to whether or not the output voltage of the power source for the first LED 120-1 has a voltage value in a range which enables a first channel corresponding to the first LED 120-1 to be driven normally.

Furthermore, as can be seen from the description regarding the light-emitting device drive unit 130 and the dimmer drive unit 140, a current value of the dimmer drive unit 140 of CH1 and a current value of the light-emitting device drive unit 130 of CH2 to CH4 are completely independent to each other. At this time, CH1 sets tens of mA of current in accordance with driving of the dimmer 112, and the light-emitting device drive unit 130 of CH2 to CH4 may be set in accordance with brightness desired by a user.

Furthermore, in the lamp dimming system 100 of this configuration, when a current of the light-emitting drive unit 130 of CH2 to CH4 flows in a state in which a current of CH1 flows, a current of CH1 is turned off immediately. This is intended to prevent a dimmer drive current of CH1 from flowing during an entire cycle which may cause a reduction in efficiency of an LED lighting function because the dimmer 112 is normally operated regardless of the dimmer drive current of CH1 or a light-emitting device drive current of CH2 to CH4 when the current value of the dimmer becomes more than a constant current value.

Next, the detailed embodiments of the lamp dimming system which is conceptually described in the section regarding FIG. 5 will be described with reference to FIGS. 6 to 8.

First, referring to FIG. 6, a lamp dimming system 200 includes: a power source 210; a lighting unit 220; a light-emitting device drive unit 230; a dimmer drive unit 240; and a common grounding resistance 250. Here, the operations of the power source 210, the lighting unit 220, the light-emitting device drive unit 230, and the dimmer drive unit 240 are identical to those of the corresponding elements of the lamp dimming system 100 described in the embodiment of FIG. 5. In the present embodiment, the detailed configurations will be described on the basis of circuit elements of the respective configurations, and with regard to elements which overlap with those of the embodiment of FIG. 5, only terms and basic operations thereof will be described.

The power source 210 includes a power input terminal in which an external alternating current power source is input, a dimmer 212, and a rectifier circuit 213, and the lighting unit 220 is composed of a plurality of LEDs 220-1 to 220-6.

The light-emitting device drive unit 230 includes switching circuits 231 and dimmer control circuits 232.

The switching circuits 231 include a switching element 231*a* and a comparator 231*b*.

The switching circuits 231*a* are connected to the common grounding resistance 250 at the same time as being connected to the output terminal of the LEDs 220-1 to 220-6, and the present embodiment shows an example in which the switching element 231*a* is a field-effect transistor (MOS FET), but the present invention is not limited thereto. The field-effect transistor 231*a* is configured such that a drain is connected to the output terminal of the LEDs 220-1 to 220-6, a source is connected to the common grounding resistance 250, and a gate is connected to the comparator 231*b*.

The comparator 231*b* compares a reference voltage corresponding to the LEDs 220-1 to 220-6 with a common voltage of the common grounding resistance 250, and depending on output of the comparator 231*b*, the switching element 231*a* is switched to any one path of a first current path connected to the LEDs 220-1 to 220-6 and a second current path connected to the common grounding resistance 250, thereby varying the common voltage of the common grounding resistance 250.

Furthermore, in the light-emitting drive unit 230, based on any one field-effect transistor of the field-effect transistors 231*a* of the switching circuits 231, when a drain voltage value of the corresponding field-effect transistor 231*a* is a voltage value which enables the corresponding current supply channel (hereinafter briefly referred as 'CH' as that of the embodiment of FIG. 5) to be operated, but does not enable the CH of the next field-effect transistor 231*a* to be operated, the drain voltage value of the field-effect transistor 231*a* connected to the operable CH is fixed as a common voltage value in a source of the field-effect transistor 231 individually included in the respective switching circuits.

The dimmer control circuits 232 sense a gate voltage of the field-effect transistor 231*a*, and thereafter, output a control signal for the dimmer drive unit 240 according to a sensing result. The dimmer control circuits 232 may include a comparator 232*a* and an inverting buffer 232*b*.

In the comparator 232*a*, an output voltage of the comparator 231*b* included in the switching circuits 231 is applied to an (−) input voltage, and at the same time, a higher voltage value than the output voltage of the comparator 231*b* included in the switching circuits 231 is applied to an (+) input voltage under the condition that the output voltage of the comparator 231*b* included in the switching circuits 231 is the voltage value which enables the corresponding CH to be operated normally. The inverting buffer 232*b* outputs an on/off control signal to a CH for supplying a bleeding current of the dimmer drive unit 240 according to an output signal of the comparator 232*a* included in the dimmer control circuits 232.

The common grounding resistance 250 is configured such that a plurality of switching circuits 231 is grounded in common.

Explaining an operation of the lamp dimming system 200 configured as above, when the VRECT voltage is increased from zero to a voltage which enables CH1 to be driven, the bleeding current flows through CH1. Furthermore, the VRECT voltage meets a condition which enables a current to flow through CH2 as it is continuously increased, and accordingly, when it is detected that the current flows through CH2, or a signal for confirming normal drive of CH2 is detected, CH1 is turned off.

Also, when the VRECT voltage is sufficiently increased up to a voltage which enables the light-emitting device drive unit 230 to operate, the current flows only to the light-emitting device drive unit 230. In this state, when the VRECT voltage is continuously reduced in reverse, a value of the current which flows along CH2 is sensed in a state of being very low or when a signal for confirming that CH2 is turned off is detected, CH1 is turned on again.

Confirmation as to whether or not CH1 is operated is carried out through VG2 and V5 included in the dimmer circuits 232, and comparator 232*a*, and feedback of each of the current sources is performed through voltage sources of V2, V3 and V4 of the respective switching circuits 231 having a common source. Here, a relation among V1, V2, V3, V4, V5 which are major voltage sources will be described as follows.

V1 is intended to set a bleeding current value and is set to be increased up to a level necessary for the dimmer operation. Here, the bleeding current value is V1/R1.

V2, V3, and V4 are intended to set current values of CH2, CH3, and CH4, and when a drain voltage value of each of the CHs is sufficient to operate the CHs, but is not sufficient to operate a next CH, V2, V3, and V4 are operated so that a common source is fixed as a voltage value of a CH positioned at the rearmost part. For this, V2, V3, and V4 have a current value of V2<V3<V4. As one example, when values of the drain of CH2 and the drain of CH3 are only sufficient to operate the current sources of CH2 and CH3, but are not sufficient to operate CH4 because a value of VRECT is high, a loop of CH3 is formed so that a value of the common source has the value of V3, and accordingly, CH3 is operated. At this time, since a source is V3, a value of VG2 is reduced up to zero due to a relation of V2<V3, CH2 is turned off. Also, since the value of VG2 is zero, V2, V3, and V4 become lower than V5 unconditionally. Accordingly, CH1 is also turned off, thereby satisfying a condition in which only CH3 is operated.

Last, V5 is intended to confirm a normal operation of CH2, and a value of VG2 should be set to be higher than a value at the time of normal operation. For example, when VG2 is normally operated, if it is designed so as to have the value of VDD/2, the value should be satisfied with the value of V5>VDD/2+Voffset. At this time, the Voffset refers to an offset voltage which can be generated at the time of manufacturing it practically at OPA2. Here, when CH2 is normally operated as a current source, a situation of VG2<V5 occurs, and accordingly, when the light-emitting device drive unit 230 is operated by generating a signal for turning off CH 1, the dimmer drive unit 240 is operated to be turned off.

Referring to FIG. 7, a lamp dimming system 300 includes a power source 310, a lighting unit 320, a light-emitting device drive unit 330 and a dimmer drive unit 340. Like the embodiment of FIG. 6, the operations of the power source 310, the lighting unit 320, and the light-emitting drive unit 330, and the dimmer drive unit 340 are identical to those of the corresponding elements of the lamp dimming system 100 described in the section regarding the embodiment of FIG. 5. In the present embodiment, the detailed configurations will be described on the basis of circuit elements of the respective configurations, and with regard to elements which overlap with those of the embodiment of FIG. 5, only terms and basic operations thereof will be described.

The power source 310 includes a power input terminal in which an external alternating current power source is input, a dimmer 312, and a rectifier circuit, and the lighting unit 320 is composed of a plurality of LEDs 320-1 to 320-6.

The light-emitting drive unit 330 includes switching circuits 331 and dimmer control circuits 332. a direction relatively close to a connection point between the power source 310 and the first light-emitting device 320-1 is fixed as the front, the dimmer control circuits 332 may be connected to the switching circuits, respectively and may be formed in plural number, the plurality of switching circuits 331 may be all formed in the same structure as that of circuits of the dimmer drive unit 340, and the driving of each of the switching circuits is controlled by the control signals of the dimmer control circuits 332 positioned at the rear. Here, each of the switching circuits 331 may be turned on/off according to whether or not an input voltage of the dimmer control circuits 332 positioned at the rear is a voltage value in a range which enables the LEDs 320-1 to 320-6 of the corresponding current supply channels to be driven normally.

Since the dimmer drive unit 340 is identical to the dimmer drive unit 240 of the embodiment described with reference to FIG. 6, the detailed description thereof will be omitted.

As can be seen from the configuration, in the lamp dimming system 200 according to the embodiment of FIG. 6, a main characteristic of the lamp dimming system 300 according to the present embodiment is to extend the relation of CH1 and CH2 in the lamp dimming system 200 of the embodiment of FIG. 6 to a relation of CH1 to CH4. That is, in the embodiment of FIG. 6, whether or not to operate CH1 is determined by detecting VG2 of CH2, whereas in the present embodiment, whether or not to operate CH2 is determined by detecting VG3 of CH3, and whether or not to operate CH3 is determined by detecting VG4 of CH4. Accordingly, the values of V2 to V4 may be freely set compared to those of the embodiment of FIG. 6, and this serves as an advantage that I_LED current waveforms can be freely set.

Next, referring to FIG. 8, a lamp dimming system 400 includes a power source 410, a lighting unit 420, a light-emitting drive unit 430, and a dimmer drive unit 440. Furthermore, like the embodiments of FIGS. 6 and 7, the operations of the power source 410, the lighting unit 420, and the light-emitting drive unit 430, and the dimmer drive unit 440 are identical to those of the corresponding elements of the lamp dimming system 100 described in the section regarding the embodiment of FIG. 5. Also, in comparison to the lamp dimming system 200 according to the embodiment of FIG. 6, only the dimmer control circuits 432 of the light-emitting device drive unit 430 are different from the elements of the lamp dimming system 400, and accordingly, the lamp dimming system 400 will be briefly described on the basis of the dimmer control circuits 432.

The dimmer control circuits 432 of the present embodiment sense a drain voltage of a field-effect transistor (MOS FET) which is a switching source, and thereafter, outputs a control signal for the dimmer drive unit 440 according to a sensing result. Thus, in the lamp dimming system 200 according to FIG. 6, when CH2 is normally operated (a saturation operation by FET of CH2), CH1 is turned off, whereas in the present embodiment, according to a design of the circuits, even though CH2 is before it and is normally operated (a triode operation by FET of CH2), when the drain voltage of CH2 is formed in a certain level, CH1 may be turned off.

Figure 9:
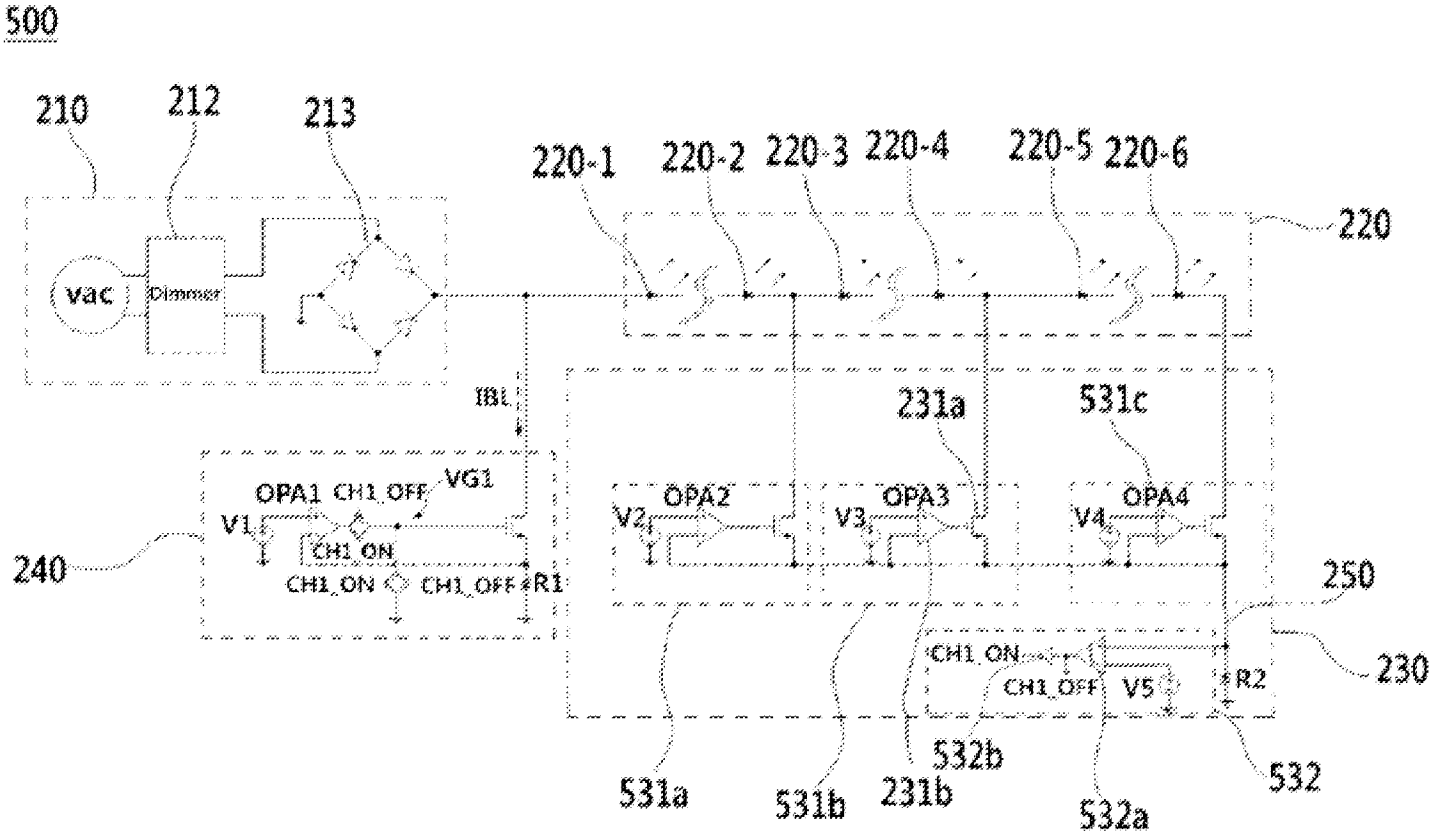
FIG. 9 is a view showing a fourth embodiment of a dimming system of a lamp using a light-emitting device according to one embodiment of the present invention.

Next, referring to FIG. 9, a lamp dimming system 500 includes the power source 210, the lighting unit 220, the light-emitting device drive unit 230, and the dimmer drive unit 240. Furthermore, like the embodiments of FIGS. 6 and 7, the operations of the power source 210, the lighting unit 220, and the light-emitting drive unit 230, and the dimmer drive unit 240 are identical to those of the corresponding elements of the lamp dimming system 100 described in the section regarding the embodiment of FIG. 5. Also, in comparison to the lamp dimming system 200 according to the embodiment of FIG. 6, only dimmer control circuits 532 of the light-emitting device drive unit 230 are different from the elements of the lamp dimming system 400, and accordingly, the lamp dimming system 500 will be briefly described on the basis of the dimmer control circuits 532. Furthermore, with regard to the same elements as those of FIG. 6, the same reference numerals will be used through the drawings, and the detailed description thereon will be omitted.

The dimmer control circuits 532 of the present embodiment are configured to sense a source voltage of the field-effect transistor (MOS FET) which is a switching element, and thereafter to output a control signal for the dimmer drive unit 240 according to a sensing result, wherein the dimmer control circuits 532 are common-connected to the source output terminals of all switching circuits. Accordingly, as the embodiment of FIG. 7, when a switching circuit which is the closest to the power source is fixed as a first switching circuit 531*a*, the switching circuit may be controlled so that whether or not CH1 is operated by the first switching circuit 531*a* is determined by detecting a source output voltage of a second switching circuit 532*b*, and whether or not CH2 is operated by the second switching circuit 532*b* is determined by detecting a source output voltage of a third switching circuit 532*c*.

Also, in a comparator 532*a* of the dimmer control circuit 532, a source voltage of a field-effect transistor included in the switching circuit (the third switching circuit of the present embodiment) positioned at the longest distance from the power source 210 is applied to an (−) input voltage, and at the same time, a lower voltage value than an input voltage value of the comparator included in the switching circuit is applied to an (−) input voltage. An inverting buffer 532*b* outputs an on/off control signal for a bleeding current supply channel of the dimmer drive unit 240 according to an output signal of the comparator 532*a* included in the dimmer control circuits 532.

Figure 10:
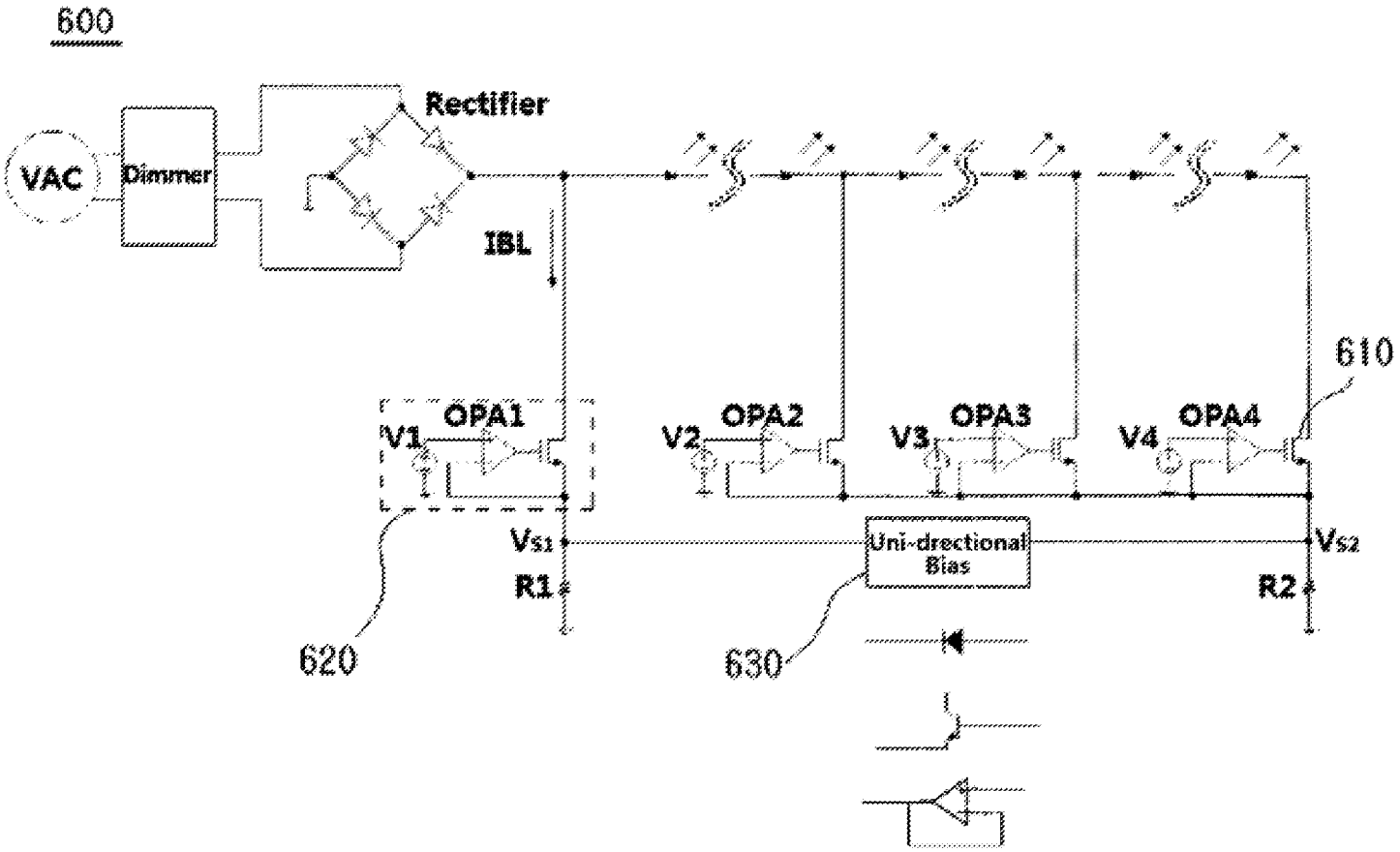
FIG. 10 is a view showing a fifth embodiment of a dimming system of a lamp using a light-emitting device according to one embodiment of the present invention.

Next, referring to FIG. 10, a lamp dimming system 600 includes a bias element 630 that changes an operation condition of a dimmer drive unit 620 by receiving a source voltage value of a field-effect transistor 610 as a signal inputted for control of the dimmer drive unit 620, and enables the signal to be transmitted between a source output terminal of the field-effect transistor 610 and an input terminal of the dimmer drive unit 620 only in a direction of the dimmer control circuits from the source output terminal of the field-effect transistor 610.

Additionally explaining the bias element based on the drawing, the bias element 630 transmits an electrical signal by $V_{S2}$ to $V_{S1}$, but blocks an electrical signal of $V_{S1}$ not to be transmitted to $V_{S2}$. Furthermore, the bias element 630 changes an operation condition of the dimmer drive unit 620 by changing $V_{s1}$ through $V_{S2}$. Also, a diode, a transistor, an OP amplifier and the like may be used as the bias element 630.

Next, operation characteristics of the lamp dimming system according to the embodiments of the present invention will be described with reference to FIGS. 11 to 14.

Figure 11:
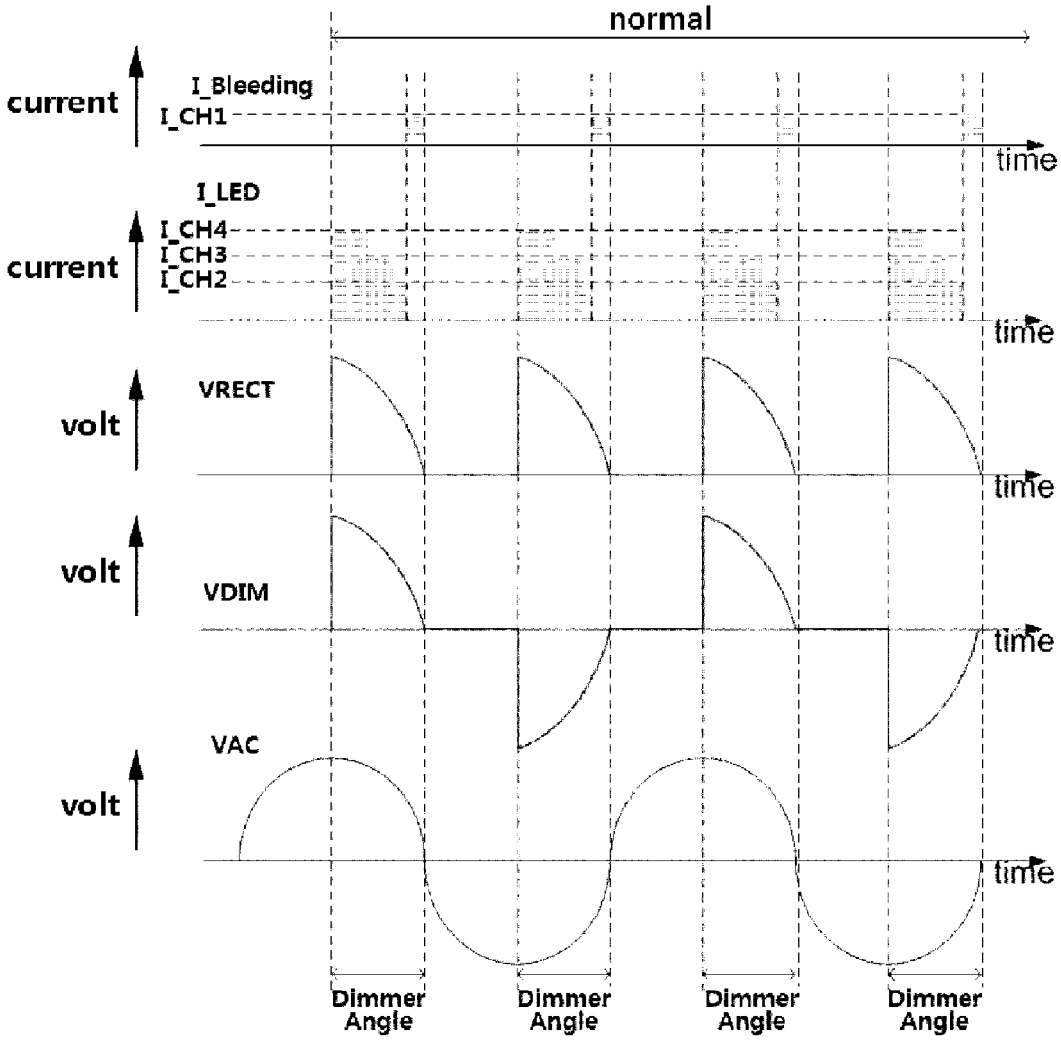
FIGS. 11 and 12 are views showing operational waveforms at the time of applying a leading edge type dimmer to the dimming system of the lamp using the light-emitting device according to one embodiment of the present invention.
Figure 12:
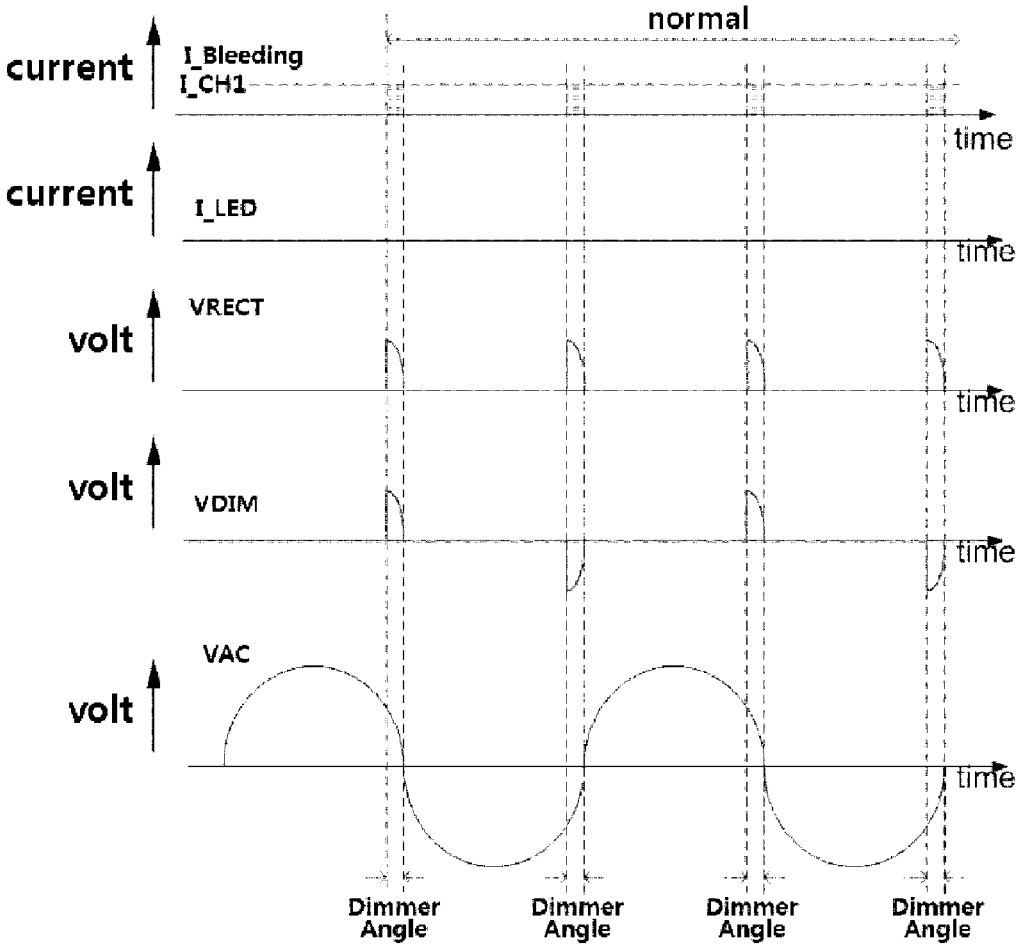

FIGS. 11 and 12 are views showing operational waveforms at the time of applying a leading edge type dimmer to the dimming system of the lamp using the light-emitting device according to embodiments of the present invention; and First, when a bleeding current source of CH1 is added, a leading edge type dimmer is applied, and thus FIG. 11 shows current sources and operational waveforms by steps when a dimmer angle is sufficiently large.

Figure 1A:
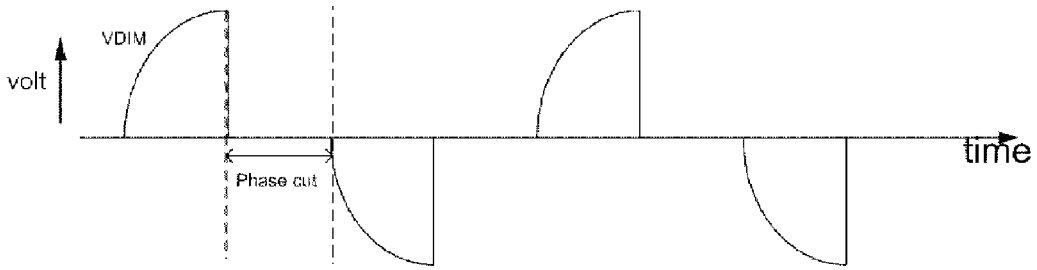
FIG.1A Prior Art
FIG. 1A and FIG. 1B show a view for explaining an operation of a general dimmer, FIG. 1A for VDIM, an output voltage of the dimmer.
Figure 1B:
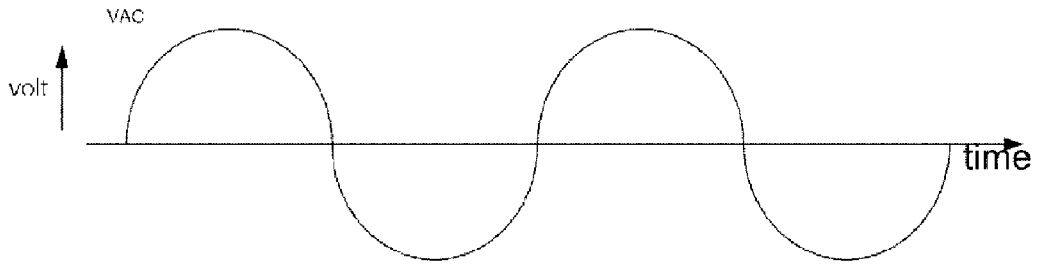
FIG.1B Prior Art
Figure 2:
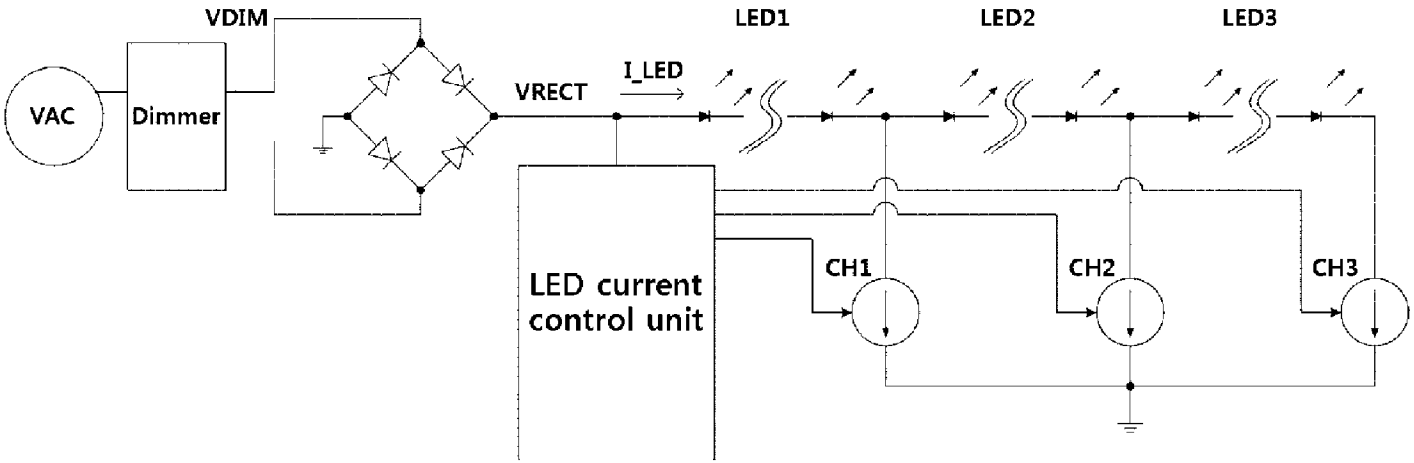
FIG.2 Prior Art
FIG. 2 is a view showing one example of conventional alternating current direct type LED lighting.
Figure 3:
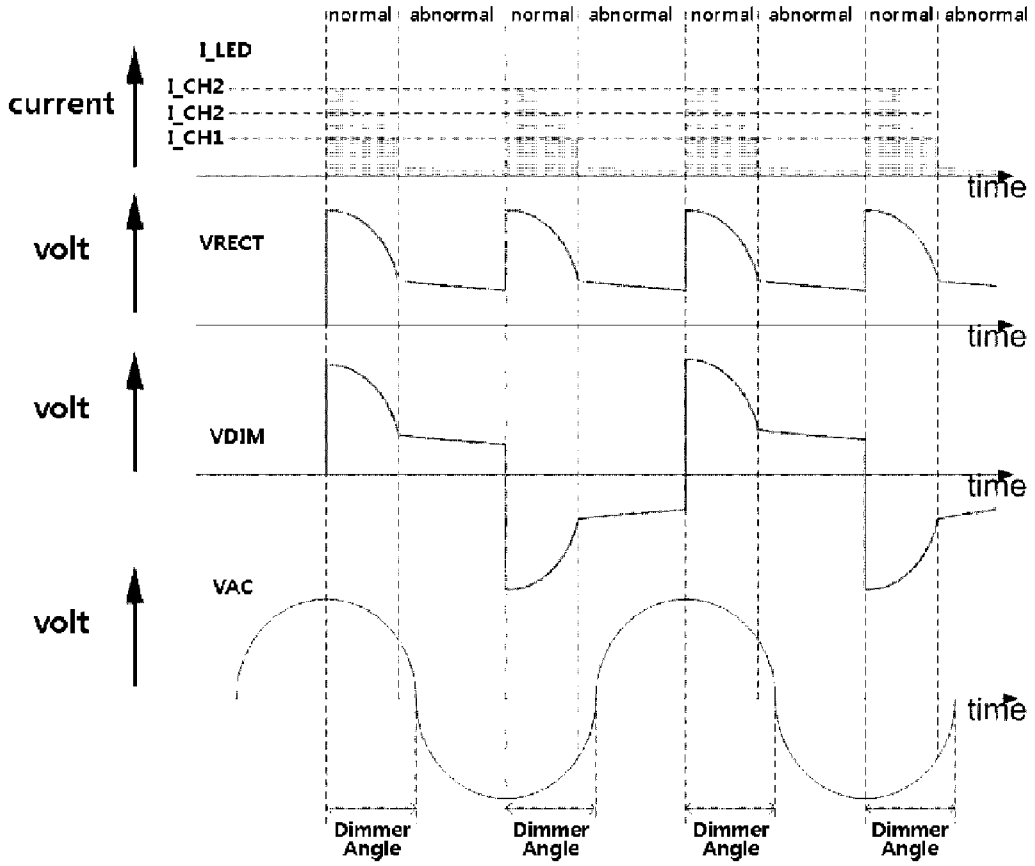
FIG.3 Prior Art
FIGS. 3 and 4 are views showing operational waveforms at the time of applying a leading edge type dimmer to the alternating current direct type LED lighting according to FIG. 2.
Figure 4:
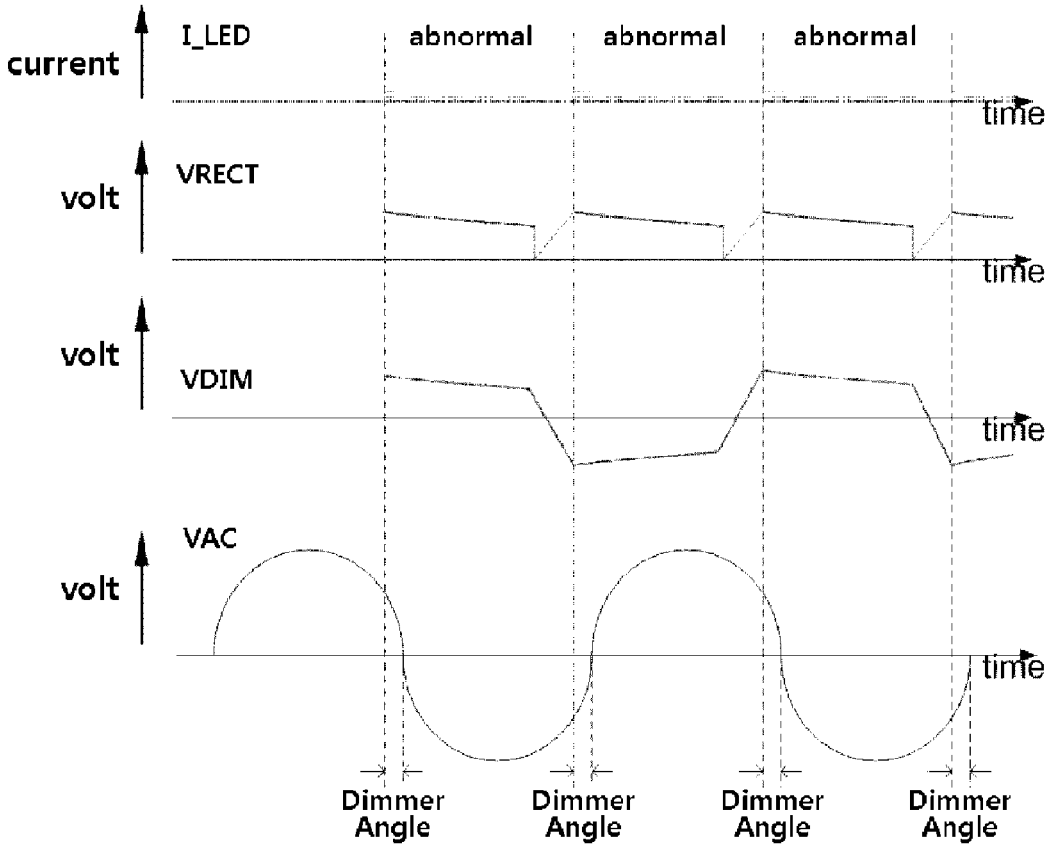
FIG.4 Prior Art

Explaining it in comparison of FIG. 3 showing the conventional art, when the value of I_LED is more than a specific value, the dimmer is normally operated, and accordingly, the values of VDIM and VRECT are normal, and this matter is identical to that of FIG. 3. However, when CH1 is used to drive the dimmer as it is used as the bleeding current source, even in a case where the value of I_LED is zero, an I_bleeding current path having a large value is formed so an output current of the dimmer is formed until an output voltage (VDIM) of the dimmer is reduced to zero, and thus CH1 functions to stably turn off the dimmer. The waveforms of VDIM and VRECT are maintained in a form in which the waveforms accurately correspond to the dimmer angle, and the circuits of the embodiment of FIG. 5 are normally operated during all sections as a zero value is stably formed during a phase-cut section.

Furthermore, FIG. 12 illustrate a case in which the circuits of the embodiment of FIG. 5 are operated at a low slope of the dimmer, and through this, it can be confirmed that the problems of LED drive circuits according to conventional arts are absolutely solved. That is, the conventional LED drive circuits cause malfunction at all sections when there is no path of the dimmer output currents at the low dimmer angle, and accordingly, the values of VDIM and VERCT enable an unpredictable floating voltage to be formed by an electric charge charged in a parasitic capacitor on the dimmer output side. Furthermore, due to this, in spite of a dimmer angle in which LED lighting should be turned off, it is problematic in that the LEDs are not turned off due to minute LED leakage currents. In contrast, in FIG. 12, even at the low dimmer angle, currents flowing to the bleeding current path exist, and thus the values of VDIM and VRECT have a desired form. Accordingly, LED currents do not flow during all sections, and the LED lighting is maintained in a state of being turned off so as to be operated normally.

As can be seen from the embodiments described above, as the dimming system of the lamp using the light-emitting device according to the present invention has a dimmer drive unit, which is parallel-connected to the connection line between a rectifier circuit of an external alternating current power source and a lighting unit of a series connection structure of light-emitting devices to form a bleeding current supply channel and to be operated by it as prime power, the output current of the dimmer can be maintained until the output voltage of the dimmer is reduced to a zero value through the I_bleeding current path having a relatively large value even in a case where the I_LED value is zero, and an on/off operation of the dimmer can be stably and normally performed, whereby the light unit including the plurality of light-emitting diodes can be always normally turned on/off without malfunction such as flicker. Furthermore, this leads to the improvement of illumination intensity and energy efficiency of the lighting unit.

Although the embodiments of the present invention disclosed for illustrative purposes above are only one example for implementing the dimming system of the lamp using the light-emitting device according to the present invention, the present invention is not limited to the embodiments, those skilled in the art will appreciate that various modifications, additions and substitutions are possible, without departing from the scope and spirit of the invention as disclosed in the accompanying claims.

What is claimed is:

1. A dimming system of a lamp using a light-emitting device, the dimming system comprising:

a power source including a power input terminal to which an external alternating current power source is applied, a dimmer connected to the power input terminal to receive an alternating current voltage applied, and a rectifier circuit for the output voltage of the dimmer;

a lighting unit including light-emitting devices from a first light-emitting device positioned at the shortest distance from a connection point with the power source to an $n^{th}$ light-emitting device positioned at the longest distance from the power source, wherein the first light-emitting device is electrically connected to the power source, and the light-emitting devices are connected in series;

a light-emitting drive unit including a plurality of switching circuits individually connected to an output terminal of each of the light-emitting devices constituting the lighting unit to form a current supply channel for the corresponding LED, and dimmer control circuits connected to the switching circuits of the first light-emitting device and configured to sense whether or not a current supply channel for the first light-emitting device is normally operated, and thereafter, to output a control signal according to a result of the sensing; and a dimmer drive unit parallel-connected to a connection line between the power source and a power input terminal of the first light-emitting device to form a bleeding current supply channel, and having a switch configured to turn on/off the bleeding current supply channel depending on a control signal of the dimmer control circuits.

2. The dimming system of claim 1, wherein the light-emitting device is a lighting-emitting diode (LED).

3. The dimming system of claim 2, wherein the dimmer drive unit is turned on/off according to whether or not an output voltage of the power source for the first light-emitting device has a voltage value in a range which enables a corresponding current supply channel of the first light-emitting device to be driven normally.

4. The dimming system of claim 2, further comprising a common grounding resistance in which the plurality of switching circuits are grounded in common, wherein each of the switching circuits includes: a switching element connected to the common grounding resistance at the same time as being connected to the output terminal of the light-emitting device; and a first comparator configured to compare a reference voltage corresponding to the light emitting device with a common voltage of the common grounding resistance, wherein depending on output of the first comparator, the switching element is switched to any one path of a first current path connected to the light-emitting device and a second current path connected to the common grounding resistance, thereby varying the common voltage of the common grounding resistance.

5. The dimming system of claim 2, wherein when a direction relatively close to a connection point between the power source and the first light-emitting device is fixed as the front, the dimmer control circuits are connected to the switching circuits, respectively and are formed in plural number, and the switching circuits are formed in the same structure as that of circuits of the dimmer drive unit so that the driving of each of the switching circuits is controlled by the control signals of the dimmer control circuits positioned at the rear.

6. The dimming system of claim 1, wherein the dimmer drive unit is turned on/off according to whether or not an output voltage of the power source for the first light-emitting device has a voltage value in a range which enables a corresponding current supply channel of the first light-emitting device to be driven normally.

7. The dimming system of claim 1, further comprising a common grounding resistance in which the plurality of switching circuits are grounded in common, wherein each of the switching circuits includes: a switching element connected to the common grounding resistance at the same time as being connected to the output terminal of the light-emitting device; and a first comparator configured to compare a reference voltage corresponding to the light emitting device with a common voltage of the common grounding resistance, wherein depending on output of the first comparator, the switching element is switched to any one path of a first current path connected to the light-emitting device and a second current path connected to the common grounding resistance, thereby varying the common voltage of the common grounding resistance.

8. The dimming system of claim 7, wherein the switching element is a field-effect transistor (MOS FET) which is configured such that a drain is connected to the output terminal of the light-emitting device, a source is connected to the common grounding resistance, and a gate is connected to the first comparator.

9. The dimming system of claim 8, wherein the dimmer control circuits sense a gate voltage of the field-effect transistor, and thereafter, output a control signal for the dimmer drive unit according to a sensing result.

10. The dimming system of claim 9, wherein when a drain voltage value of the field-effect transistor is a voltage value which enables a corresponding current supply channel to be operated, but does not enable a next current supply channel to be operated, the corresponding voltage value of the operable current supply channel is set as a common voltage value in a source of the field-effect transistor individually included in each of the switching circuits.

11. The dimming system of claim 8, wherein the dimmer control circuits sense a drain voltage of the field-effect transistor, and thereafter, output a control signal for the dimmer drive unit according to a sensing result.

12. The dimming system of claim 8, wherein the dimmer control circuits sense a source voltage of the field-effect transistor, and thereafter output a control signal for the dimmer drive unit according to a sensing result.

13. The dimming system of claim 8, wherein the dimmer control circuits include: a second comparator in which the source voltage of the field-effect transistor included in the switching circuit is applied to positive input voltage, and at the same time, a lower voltage value than an input voltage of the first comparator included in the switching circuits is applied to negative input voltage; and an inverting buffer configured to output an on/off control signal for a bleeding current supplying channel of the dimmer drive unit according to an output signal of the second comparator included in the dimmer control circuits.

14. The dimming system of claim 8, wherein the dimmer control circuits include a bias element that changes an operation condition of the dimmer drive unit by receiving a source voltage value of the field-effect transistor as a signal inputted for control of the dimmer drive unit, and enables the signal to be transmitted between a source output terminal of the field-effect transistor and an input terminal of the dimmer drive unit only in a direction of the dimmer control circuits from the source output terminal of the field-effect transistor.

15. The dimming system of claim 7, wherein the dimmer control circuits include: a second comparator in which a higher voltage value than an output voltage of the first comparator included in the switching circuits is applied to positive input voltage under the condition that the output voltage of the first comparator is applied to negative input voltage and is a voltage value which enables the corresponding current supply channel to be operated normally; and an inverting buffer configured to output an on/off control signal for a bleeding current supplying channel of the dimmer drive unit according to an output signal of the second comparator included in the dimmer control circuits.

16. The dimming system of claim 1, wherein when a direction relatively close to a connection point between the power source and the first light-emitting device is fixed as the front, the dimmer control circuits are connected to the switching circuits, respectively and are formed in plural number, and the switching circuits are formed in the same structure as that of circuits of the dimmer drive unit so that the driving of each of the switching circuits is controlled by the control signals of the dimmer control circuits positioned at the rear.

17. The dimming system of claim 16, wherein each of the switching circuits is turned on/off according to whether or not an input voltage of the dimmer control circuits positioned at the rear is a voltage value in a range which enables the light-emitting device of the corresponding current supply channel to be driven normally.

* * * * *